US011834822B2

(12) United States Patent
Gantt

(10) Patent No.: US 11,834,822 B2
(45) **Date of Patent: *Dec. 5, 2023**

(54) APPARATUS AND METHOD FOR LIFTING A CONCRETE SLAB

(71) Applicant: Independence Materials Group, LLC, Virginia Beach, VA (US)

(72) Inventor: William A. Gantt, Blair, SC (US)

(73) Assignee: Independence Materials Group, LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/750,781

(22) Filed: May 23, 2022

(65) Prior Publication Data

US 2022/0282475 A1 Sep. 8, 2022

Related U.S. Application Data

(63) Continuation of application No. 16/731,671, filed on Dec. 31, 2019, now Pat. No. 11,346,099.

(60) Provisional application No. 62/786,819, filed on Dec. 31, 2018.

(51) Int. Cl.
*E04B 1/35* (2006.01)

(52) U.S. Cl.
CPC ..... *E04B 1/3511* (2013.01); *E04B 2001/3588* (2013.01)

(58) Field of Classification Search
CPC ..... E04B 1/3511; E04B 2001/3588
USPC ..... 52/125.1
See application file for complete search history.

(56) References Cited

U.S. PATENT DOCUMENTS 2,715,013 A ‡ 8/1955 Slick ..... E04B 1/3511 254/106
3,028,144 A ‡ 4/1962 Cheskin ..... E02B 17/0863 254/109
3,065,573 A ‡ 11/1962 Goldberg ..... E04B 1/3511 52/125.1
3,590,247 A 6/1971 Holford
3,594,965 A ‡ 7/1971 Saether ..... E04B 1/3511
3,705,469 A ‡ 12/1972 Eriksson ..... B28B 23/005 52/125.4
3,782,052 A * 1/1974 Vetovitz ..... E04B 1/35 248/354.3
3,875,471 A 4/1975 Buck
(Continued)

FOREIGN PATENT DOCUMENTS

WO 2010090748 A1 8/2010
WO WO-WO-2010090748 A1 ‡ 8/2010

*Primary Examiner* — Brian D Mattei
*Assistant Examiner* — Joseph J. Sadlon
(74) *Attorney, Agent, or Firm* — Moore & Van Allen PLLC; Jeffrey R. Gray

(57) ABSTRACT

A lifting system utilizing a lifting apparatus for lifting a floor (e.g., a concrete slab) using the lifting apparatus to support a floor from under the floor during lifting. The lifting apparatus may have a first portion (e.g., an extension member and saddle) installed under a slab. Piers are driven into the ground through the first portion of the lifting apparatus. Thereafter, a second portion of the lifting apparatus is operatively coupled to the to the first portion and the uppermost pier. A lifting device (e.g., hydraulic ram) is operatively coupled to the lifting apparatus and/or the pier and is used to lift the slab.

20 Claims, 14 Drawing Sheets

(56) References Cited

U.S. PATENT DOCUMENTS 3,920,780 A ‡ 11/1975 Vanderklaauw ..... E04G 13/02 264/33
4,011,705 A ‡ 3/1977 Vanderklaauw ..... E04B 1/166
RE29,249 E * 6/1977 Rice ..... E04B 1/34823 52/223.7
4,125,975 A ‡ 11/1978 Soble ..... E02D 27/00 52/126.1
4,263,757 A * 4/1981 Thys ..... E04B 1/34823 D25/33
4,320,607 A * 3/1982 Eubank ..... B66F 3/46 52/223.6
4,432,465 A ‡ 2/1984 Wuertz ..... E04B 1/947
4,517,775 A * 5/1985 Engel ..... B65F 1/141 52/118
4,590,719 A * 5/1986 McKibbin ..... E04H 12/34 52/745.18
4,800,700 A ‡ 1/1989 May ..... E02D 35/00
4,899,497 A * 2/1990 Madl, Jr. ..... E04B 1/0007 52/126.6
4,911,580 A * 3/1990 Gregory ..... E02D 35/00 405/230
5,013,190 A * 5/1991 Green ..... E02D 35/00 405/230
5,018,905 A * 5/1991 Kinder ..... E02D 27/48 405/230
5,176,472 A * 1/1993 Kinder ..... E02D 27/48 405/230
5,205,673 A ‡ 4/1993 Bolin ..... E02D 35/00 405/230
5,213,448 A * 5/1993 Seider ..... E02D 27/48 405/230
5,460,499 A * 10/1995 Franklin ..... E04B 1/3516 249/20
5,491,935 A ‡ 2/1996 Coxum ..... E04H 9/14 52/92.2
5,722,798 A ‡ 3/1998 Gregory ..... B66F 1/025 254/133 R
5,951,206 A * 9/1999 Gregory ..... E02D 35/00 405/230
5,980,162 A ‡ 11/1999 Mccown ..... E02D 5/56 405/244
6,074,133 A ‡ 6/2000 Kelsey ..... E02D 27/12 405/244
6,142,710 A * 11/2000 Holland, Jr. ..... E04G 23/065 405/230
6,347,489 B1 * 2/2002 Marshall, Jr. ..... E02D 27/00 52/126.6
6,368,022 B1 * 4/2002 Zingerman ..... E04G 21/163 405/230
6,503,024 B2 ‡ 1/2003 Rupiper ..... E02D 27/48 405/229
6,514,012 B2 ‡ 2/2003 Gregory ..... E02D 35/00 403/296
6,539,685 B2 ‡ 4/2003 Bell ..... E02D 35/00 405/229
7,094,003 B2 * 8/2006 Faires ..... E02D 35/00 405/230
7,163,357 B1 ‡ 1/2007 Peterson ..... E02D 27/48 405/229
7,435,038 B2 ‡ 10/2008 Peterson ..... E02D 27/48
7,744,316 B2 ‡ 6/2010 Kaufman ..... E02D 35/005 405/230
7,780,376 B2 ‡ 8/2010 Bracken ..... E04G 23/06 405/230
8,171,678 B2 ‡ 5/2012 Stanford ..... E02D 35/00 52/125.5
8,403,599 B2 ‡ 3/2013 Hawkins ..... E02D 35/00 405/244
8,458,984 B2 ‡ 6/2013 Marshall ..... E02D 27/32
8,540,461 B2 ‡ 9/2013 Ong ..... E02D 11/00
8,590,247 B2 ‡ 11/2013 Cooke ..... F16B 9/09 52/506.05
8,671,627 B2 * 3/2014 Marshall ..... E02D 35/005 52/125.1
8,821,073 B2 * 9/2014 Patton ..... E02D 35/005 52/741.15
8,875,471 B2 ‡ 11/2014 Siqueiros ..... E01C 23/04
8,887,451 B2 * 11/2014 Gregory ..... E04G 23/065 52/741.15
8,926,227 B2 ‡ 1/2015 Zago ..... E02D 7/20 405/230
9,068,347 B2 ‡ 6/2015 Moeller ..... F16B 5/0225
9,133,640 B2 * 9/2015 Cantoni ..... F16M 13/00
9,279,227 B2 ‡ 3/2016 West ..... E02D 5/54
9,347,232 B1 * 5/2016 Francies, III ..... E04B 5/04
RE46,831 E ‡ 5/2018 Francies, III ..... E04B 5/04
10,294,625 B1 ‡ 5/2019 Fontaine ..... E02D 17/08
10,450,715 B2 * 10/2019 Marshall ..... E04G 21/163
10,486,330 B2 ‡ 11/2019 Giles ..... B28B 1/001
10,501,895 B2 ‡ 12/2019 Costa ..... E01C 11/14
10,570,608 B2 * 2/2020 Bertuca ..... E04G 21/168
11,015,335 B2 * 5/2021 Connell ..... E04G 21/142
2007/0028557 A1 * 2/2007 Kelly ..... E02D 27/34 52/741.15
2008/0236061 A1 ‡ 10/2008 Hickman ..... E02D 35/00 52/125.1
2009/0245942 A1 ‡ 10/2009 Hawkins ..... E02D 27/48
2011/0052329 A1 * 3/2011 Marshall ..... E02D 31/10 405/229
2011/0116873 A1 * 5/2011 Marshall ..... E02D 35/00 405/230
2011/0252722 A1 * 10/2011 Laurin ..... E02D 27/32 52/126.6
2013/0269269 A1 * 10/2013 Marshall ..... E02D 35/005 52/125.1
2014/0096458 A1 * 4/2014 Benet ..... E02D 27/32 52/741.3
2015/0021530 A1 ‡ 1/2015 Gregory ..... E02D 35/005
2015/0047271 A1 * 2/2015 Davis ..... E02D 35/005 52/741.15

* cited by examiner
‡ imported from a related application

APPARATUS AND METHOD FOR LIFTING A CONCRETE SLAB

RELATED APPLICATIONS AND PRIORITY CLAIM

The present Application for a Patent is a continuation of, and claims priority to U.S. Pat. No. 11,346,099 entitled "Apparatus and Method for Lifting a Concrete Slab" filed on Dec. 31, 2019, which claims priority to U.S. Provisional Patent Application Ser. No. 62/786,819 entitled "Apparatus and Method for Lifting a Concrete Slab," which was filed on Dec. 31, 2018, all of which are assigned to the assignees hereof and are hereby expressly incorporated by reference herein.

FIELD

An apparatus, system, and method for lifting a concrete slab is described and, more particularly, the apparatus is a bracket for disposition in an opening in a concrete slab and is configured for connection to a lifting device for raising the bracket, and thus the slab.

BACKGROUND

Building foundations settle, especially in certain soil conditions, with resultant damage to building structures, including cracks and fissures in the walls, foundation, and foundation slabs. Foundation slabs frequently have an extensive lateral expanse, with their peripheral edge portions resting on or abutting the peripheral foundation footing of the building. As foundation slabs settle, they tend to buckle, particularly in the middle between the supporting foundation walls and footings.

Foundation slab settling problems can be alleviated by supporting and lifting of the foundation slabs. Once the foundation slab is lifted, it is fixed to piers embedded in the ground that support the foundation. However, foundation slabs normally have a relatively small thickness on the order of about four inches. As a result, foundation slabs do not have good side-to-side strength permitting them to be lifted along with the perimeter footing or foundation, even when a plurality of lift points are utilized around the perimeter of a settled building. When perimeter lifting is utilized the slab frequently tends to settle in the center.

As such, improved apparatus, systems, and methods may be required to allow for lifting of slabs in a way that mitigates damage to the slab.

BRIEF SUMMARY

The present disclosure relates to a lifting system utilizing a lifting apparatus for lifting a floor (e.g., a concrete slab) using the lifting apparatus to support a floor from under the floor during lifting. The lifting apparatus may have a first portion (e.g., an extension member and saddle) installed under a slab. Piers are driven into the ground through the first portion of the lifting apparatus. Thereafter, a second portion of the lifting apparatus is operatively coupled to the to the first portion and the uppermost pier. A lifting device (e.g., hydraulic ram) is operatively coupled to the lifting apparatus and/or the pier and is used to lift the slab.

Embodiments of the invention comprises lifting apparatuses. The apparatuses may comprise a first portion, a second portion, and one or more lifting rods operatively coupled to at least the first portion. The apparatus is configured to be operatively coupled to a floor and to one or more piers. The first portion extends outwardly under the floor and is operatively coupled to a lower surface of the floor. The second portion is configured to be operatively coupled with the first portion and the one or more piers, and wherein the first portion, the second portion, and the floor are operatively coupled to restrict movement between the first portion, the second portion, the one or more piers, and the floor.

In further accord with embodiments of the invention, the first portion has one or more internal edges that define a nesting aperture, and wherein the second portion is configured to nest at least partially within the nesting aperture of the first portion.

In other embodiments of the invention, the first portion has a first portion aperture, wherein the first portion aperture is configured to receive the one or more piers.

In yet other embodiments of the invention, the second portion is configured to be operatively coupled with an end of a pier of the one or more piers, and the end of the pier and the second portion are configured to be located below an upper surface of the floor.

In still other embodiments of the invention, the first portion comprises an extension plate, and a saddle operatively coupled to the extension plate.

In further accord with embodiments of the invention, the extension plate comprises a first plate and a second plate. The first plate and the second plate engage the lower surface of the floor adjacent a floor opening around a majority of the floor opening.

In other embodiments of the invention, the first plate or the second plate are c-shaped plates.

In still other embodiments of the invention, the saddle comprises a base and walls operatively coupled to and extending from the base. The walls and the base form a trough and the walls are operatively coupled to the extension plate.

In yet other embodiments of the invention, the second portion comprises a cap for covering a pier aperture of a pier of the one or more piers.

Other embodiments of the invention comprise lifting systems comprising a lifting apparatus and one or more piers operatively coupled to the lifting apparatus. The lifting apparatus comprises a first portion, a second portion, and one or more lifting rods operatively coupled to at least the first portion. The lifting apparatus is configured to be operatively coupled to a floor and to the one or more piers. The first portion extends outwardly under the floor and is operatively coupled to a lower surface of the floor. The second portion is configured to be operatively coupled with the first portion and the one or more piers, and the first portion, the second portion, and the floor are operatively coupled to restrict movement between the first portion, the second portion, the one or more piers, and the floor.

In further accord with embodiments of the invention, the first portion has one or more internal edges that define a nesting aperture, and the second portion is configured to nest at least partially within the nesting aperture of the first portion.

In other embodiments of the invention, the first portion has a first portion aperture, wherein the first portion aperture is configured to receive the one or more piers.

In still other embodiments of the invention, the second portion is configured to be operatively coupled with an end of a pier of the one or more piers, wherein the end of the pier and the second portion are configured to be located below an upper surface of the floor.

In yet other embodiments of the invention, the first portion comprises an extension plate and a saddle operatively coupled to the extension plate.

In further accord with embodiments of the invention, the extension plate comprises a first plate and a second plate. The first plate and the second plate engage the lower surface of the floor adjacent a floor opening around a majority of the floor opening.

In other embodiments of the invention, the first plate or the second plate are c-shaped plates.

In still other embodiments of the invention, the saddle comprises a base and walls operatively coupled to and extending from the base. The walls and the base form a trough and the walls are operatively coupled to the extension plate.

In yet other embodiments of the invention, the second portion comprises a cap for covering a pier aperture of a pier of the one or more piers.

Other embodiments of the invention comprise methods of installing a lifting system. The methods may comprise inserting at least a section of a first portion of a lifting apparatus in a floor aperture of a floor and inserting one or more piers through a first portion aperture of the lifting apparatus using a pier drive. The methods may further comprise assembling a second portion of the lifting apparatus to the first portion and the pier and assembling a lifting drive to the lifting apparatus. The methods may also comprise lifting the floor using the lifting drive to lift the lifting apparatus, and removing the lifting drive from the lifting apparatus.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DESCRIPTION

Figure 1A:
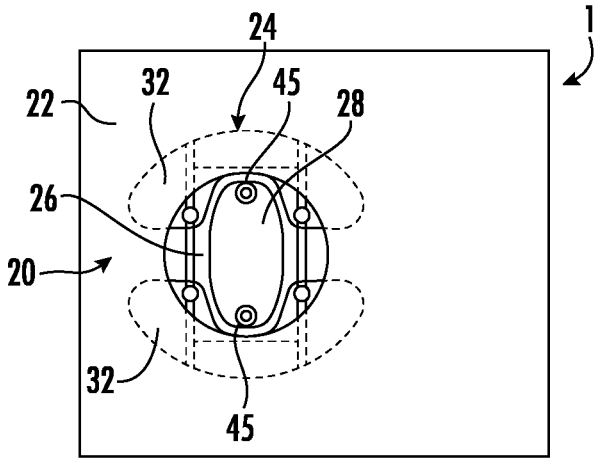
FIG. 1A is a top plan view of a lifting system including a lifting apparatus for lifting a concrete slab in a first side orientation, in accordance with embodiments of the present disclosure.

Embodiments of the present disclosure now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Referring now to the drawings, wherein like reference numerals designate corresponding or similar elements throughout the several views, a system 1, including an apparatus 20 therein, for use in lifting a floor (e.g., a slab 22, such as a concrete slab) is shown in FIGS. 1A-2B and 3. The lifting system 1 is generally designed as 1, and the lifting apparatus 20 utilized within the lifting system 1, is generally designated at 20. The lifting apparatus 20 may also be referred to herein as a "lift bracket" or "lifting bracket", and may be used for supporting and lifting a floor (e.g., a floor slab—a foundation slab 22, or the like of a building) with no, or a minimal amount of, damage to the floor (e.g., cracking, breaking away, or the like of the slab 22) while minimizing excavation under the floor inside the building.

The lifting apparatus 20 comprises a first portion 21, such as a lower portion as the lifting apparatus 20 is installed with respect to the floor (e.g., the slab 22). The first portion 21 may comprise an extension member 24 (e.g., an extension plate) and a saddle 26 (e.g., a pier saddle) operatively coupled to the extension member 24. The lifting apparatus 20 may further comprise a second portion 27, such as an upper portion as the lifting apparatus 20 is installed with respect to the floor (e.g., the slab 22), configured for operative coupling with the first portion 21. The second portion 27 of the lifting apparatus 20 may comprise a cap 28 (e.g., pier cap), which may be operatively coupled to the to the first portion 21 through a one or more lifting rods 44 (e.g., a pair of lifting rods 44 at each end of the first portion 21, or the like) as will be described in further detail below. Moreover, as will be further described herein, the second portion 27 may also be operatively coupled to an end of a pier 40 (e.g., an uppermost pier) of the one or more piers 40 that are driven into the ground 42 (e.g., driven through the installed lifting apparatus 20).

In some embodiments, the first portion 21 may comprise an extension member 24 (e.g., may comprise one or more plate members, such as a first plate and a second plate). It should be understood that the one or more plate members may be formed as any shape and size (e.g., uniform, non-uniform, circular, triangular, half-circle, square, rectangular, or the like). In some embodiments, the one or more plate members may comprise a pair of elongated planar and generally C-shaped discs 32 (e.g., flat C-shaped discs having a uniform or non-uniform thickness, or the like). When the lifting apparatus 20 is assembled under a floor, the extension member 24 (e.g., the one or more plates, such as the opposing discs 32, or the like) may be adapted such that the edges of the extension member 24 (e.g., the one or more plates, such as the discs 32) extend horizontally outwardly under the floor (e.g., under the slab 22, or the like) in supporting engagement of the floor (e.g., the slab 22). For example, the extension member 24 (e.g., the first plate and the second plate, such as the discs 32) engages a lower surface of the floor around the majority of a floor aperture (e.g., an access opening 50). As such, the extension member 24 may engage 50, 60, 70, 75, 80, 85, 90, and/or 100 percent of the lower surface of the floor adjacent the floor aperture (e.g., around the circumference of the floor opening, or the like), or range between, overlap, or fall outside of any of these percentages. Consequently, in this arrangement, the extension plate 24 acts to distribute a lifting force applied to the lower surface of the floor (e.g., the non-exposed surface of the slab 22) around the floor aperture (e.g., around the circumference of the access opening 50).

Moreover, in some embodiments, the first portion 21 of the lifting apparatus 20 may have a lifting apparatus aperture, such as a first portion aperture 35 (e.g., a central circular bracket aperture, or the like) through which one or more of the piers 40 may be assembled, such as driven into the ground 42, as will be described in further detail herein. For example, the inner edges of the of the extension member 24 (e.g., the inner edges of one or more plates, such as the pair of discs 32) may form an extension aperture through which the piers 40 may pass. Furthermore, the extension member 24 may comprise one or more extension coupling apertures 33 (e.g., extension bolt holes) used to operatively couple the extension member 24 to the saddle 26, as discussed in further detail below. Furthermore, the first portion 21 of the lifting apparatus 20 may have one or more lifting rod apertures 43 (e.g., in the extension member 24 and/or the saddle 26), as will be discussed below.

The saddle 26 as previously described herein, in some embodiments, may comprise a base 34 and walls 36 (e.g., two or more walls that extend from the base 34 in order to define a U-shaped transverse cross-section). The saddle 26, such as the base 34, may also comprise the lifting apparatus aperture, such as the first portion aperture 35 (e.g., a central circular bracket aperture, or the like), through which one or more piers 40 may be assembled. For example, a saddle 26 may comprises a saddle aperture through which the piers 40 may pass. The saddle 26 may further comprise one or more saddle coupling apertures 37 (e.g., saddle bolt holes) located radially outwardly from the first portion aperture 35 (e.g., on each side of the first portion aperture 35) for operatively coupling the extension member 24 to the saddle 26, as will be discussed in further detail herein.

The walls 36 of the saddle 26 may support the underside of the extension member 24, for example, each wall 36 may support one or more of the extension plates (e.g., each individual disc 32, or the like). In some embodiments, a portion of each wall 36 (e.g., upper edge of each wall) may comprise one or more saddle coupling apertures 37 (e.g., threaded holes, or the like) to accommodate coupling fasteners 38 (e.g., threaded fasteners, such as threaded rods or bolts). Each coupling fastener 38 is inserted through the extension coupling apertures 33 (e.g., extension bolt holes) in the extension member 24 and is screwed into one of the saddle coupling apertures 37 in the saddle 26 (e.g., walls of the saddle 26). The extension member 24 and the saddle 26 are thereby operatively coupled (e.g., removably fixed, or the like) to one another. In other embodiments, the extension member 24 and the saddle 26 may be operatively coupled to each other in other ways, such as through other connectors, welds, or the like. It should be understood that the extension member 24 may be operatively coupled to the saddle 26 after the saddle 26 has been inserted into the floor aperture (e.g., access opening 50). Alternatively, the extension member 24 may be operatively coupled to the saddle 26 before being inserted into the floor aperture (e.g., access opening 50). In some embodiments, it should be understood that the extension member 24 (e.g., the plates, such as the discs 32) may move with respect to the saddle 26 (e.g., each plate together or individually with respect to each other).

The first portion aperture 35, in some embodiments may comprise a tubular member operatively coupled to the first portion 21 of the lifting apparatus (e.g., to the saddle 26 and/or the extension plates 24, or the like). Regardless of the configuration of the first portion aperture 35, the first portion aperture 35 is adapted for receiving the one or more piers 40, such as successive sections of piers 40 that are driven through the first portion aperture 35 (e.g., through an extension aperture and/or saddle aperture) and into the ground 42. The one or more piers 40 may be driven into the ground 42 using a pier drive (e.g., a manual drive, a hydraulic drive, a pneumatic drive, or any other type of drive) that is used to drive the piers 40 in to the ground below the floor (e.g., slab 22), as will be described in further detail herein (e.g., with or without a pier drive support member 48).

Figure 3:
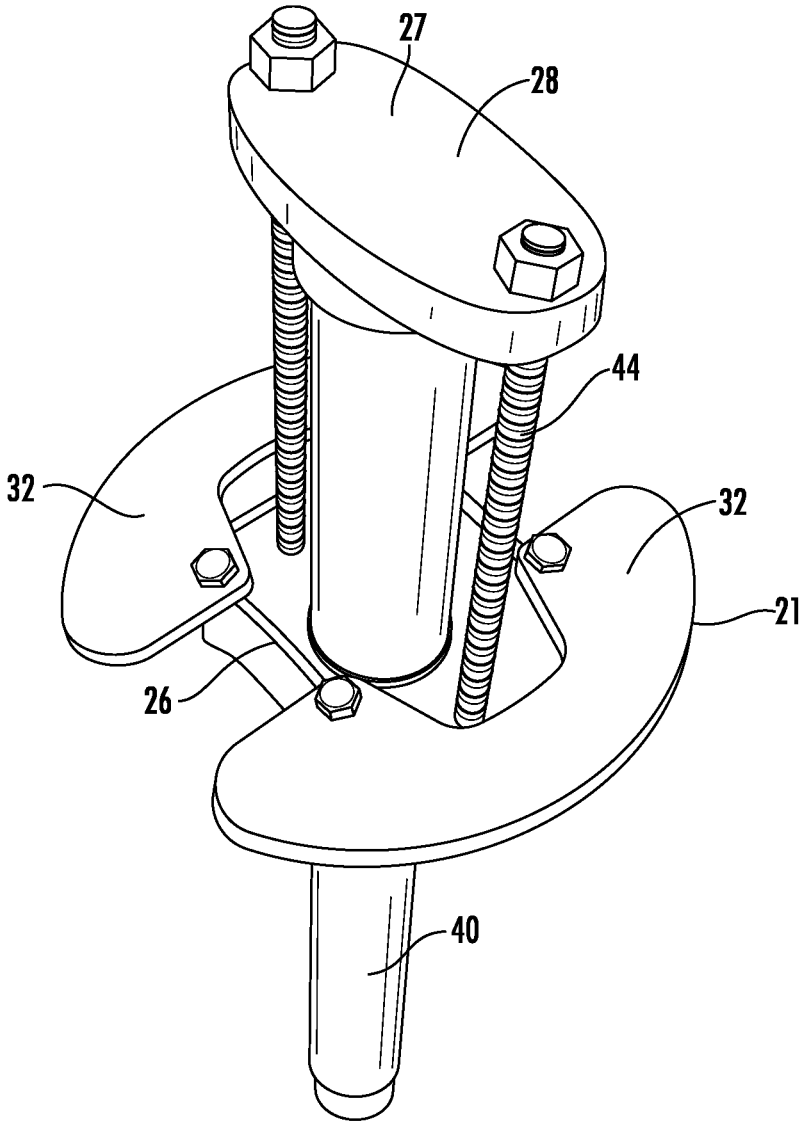
FIG. 3 is a top perspective view of the lifting system as shown in FIGS. 1A-2B as it would be installed within and/or under a floor, in accordance with embodiments of the present disclosure.
Figure 4A:
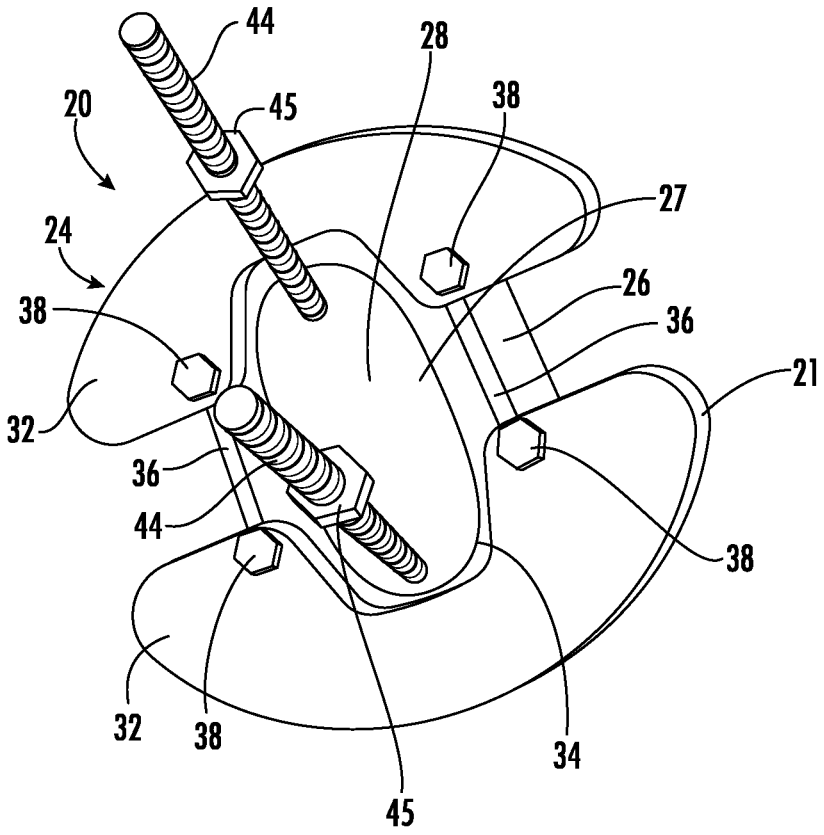
FIG. 4A is a top perspective view of the lifting apparatus as shown in FIG. 3, in accordance with embodiments of the present disclosure.
Figure 4B:
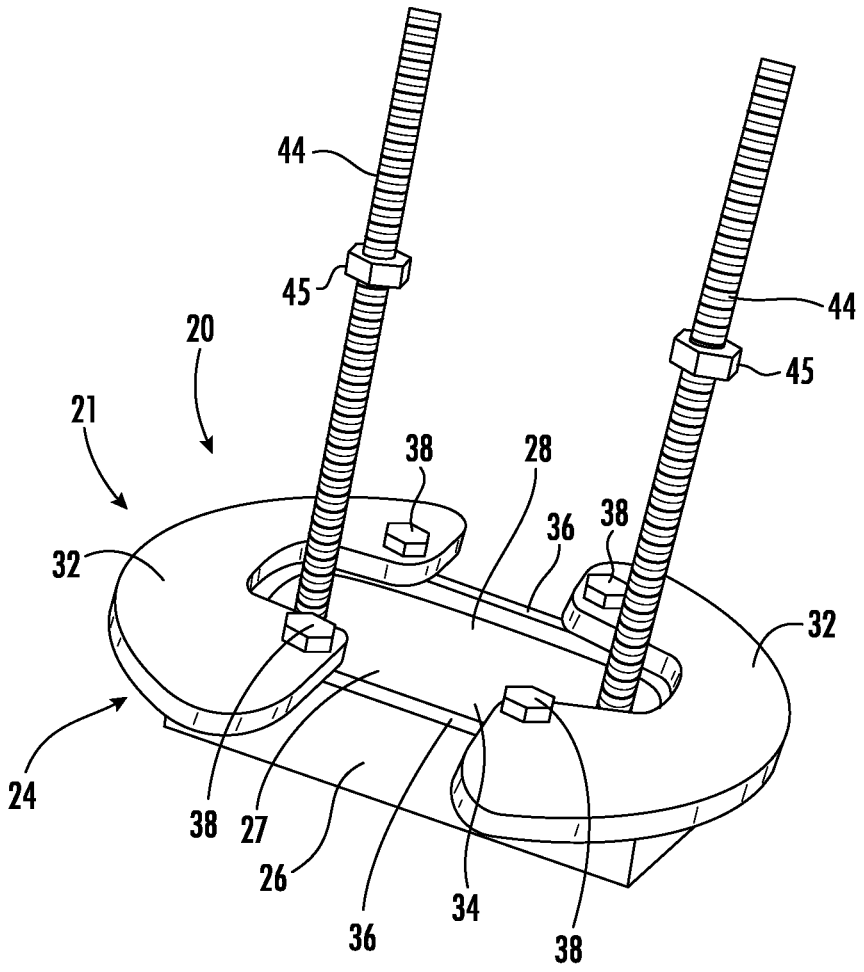
FIG. 4B is a top side perspective view of the lifting apparatus as shown in FIG. 4A, in accordance with embodiments of the present disclosure.
Figure 5A:
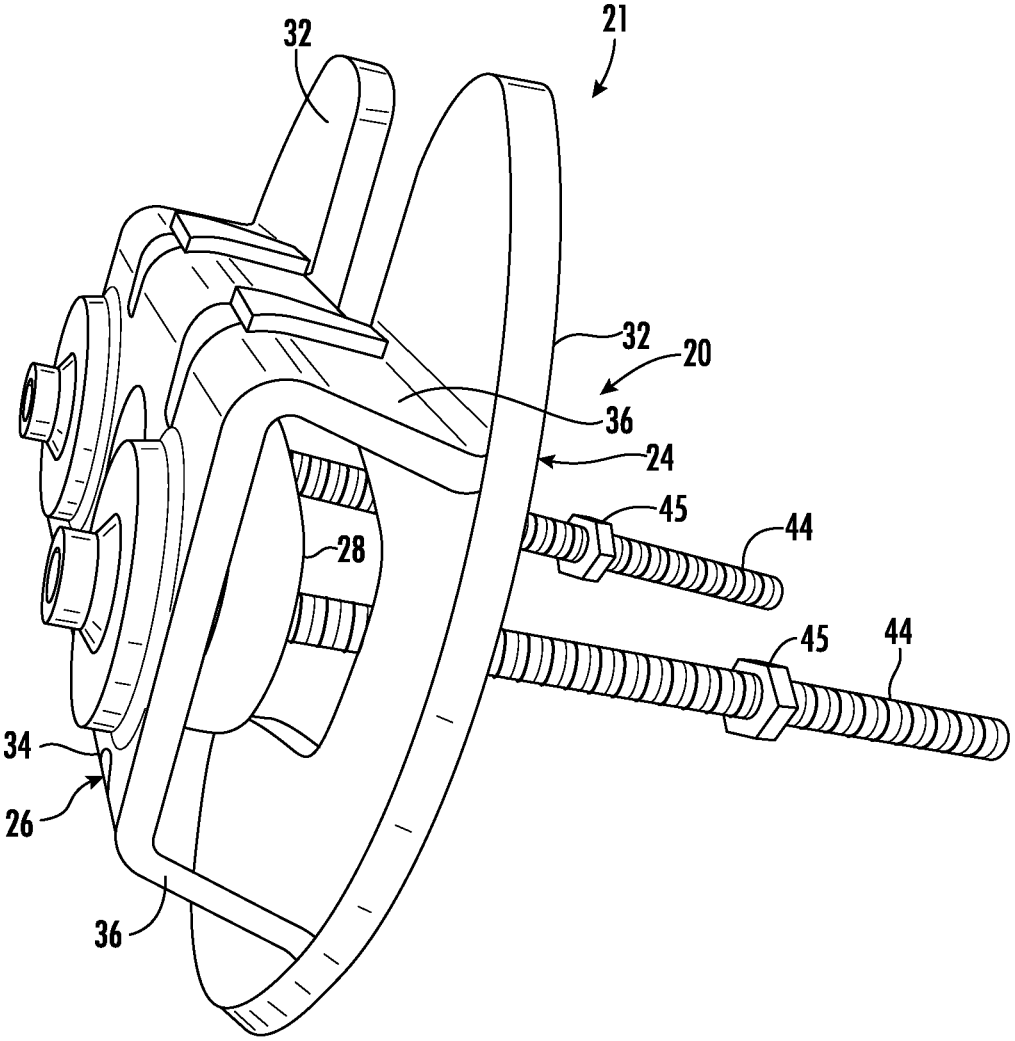
FIG. 5A is a bottom side perspective view of the lifting apparatus as shown in FIG. 3, in accordance with embodiments of the present disclosure.
Figure 5B:
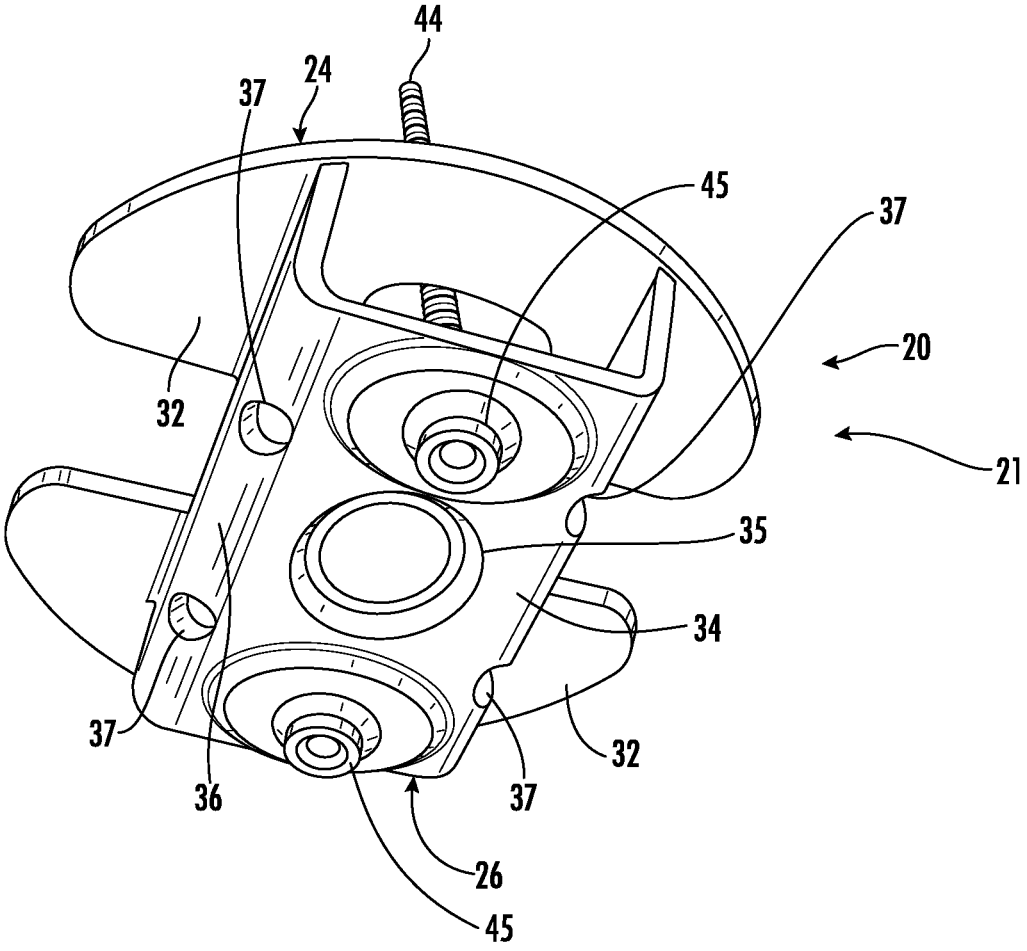
FIG. 5B is a bottom perspective view of the lifting apparatus as shown in FIG. 5A, in accordance with embodiments of the present disclosure.

As will be described in further detail herein, it should be understood that after the installation of the first portion 21 of the lifting apparatus 20 and the one or more piers 40, the second portion 27 of the lifting apparatus 20 may be installed to the upper most pier 40 and/or the first portion 21 of the lifting apparatus 20, as illustrated in FIG. 3. In some embodiments, the second portion 27 of lifting apparatus 20 may comprise a cap 28 (e.g., a pier cap). The cap 28 may cover (e.g., fits over) an outer end of a pier 40 (e.g., the last successive assembled push pier 40) extending upwardly through the first portion 21 (e.g., extension member 24 and/or pier saddle 26) of the lifting apparatus 20. The cap 28 may include an alignment portion (e.g., central circular portion) defining an annular pocket for receiving the end of the pier 40. The annular pocket in the cap 28 and the upper end of the pier 40 are preferably designed in a close fitting manner. The second portion 27 (e.g., the cap 28) of the lifting apparatus 20, may be utilized to operatively couple the one or more piers 40 to the first portion 21 of the lifting apparatus 20.

After assembly of the second portion 27, a lifting device (e.g., hydraulic ram, or the like) is temporarily installed on top of the cap 28 for lifting the floor. The lifting device may be operatively coupled through the rods 44, another set of rods and/or caps through threaded couplers to the lifting rods 44 or the lifting apparatus 20, or the like. The lifting device (e.g., hydraulic ram, or the like) is extended (e.g., loaded), which transfers the weight of the slab to the first portion 21 (e.g., the saddle 26) of the lifting apparatus 20. The second portion 27 (e.g., cap 28) is then operatively coupled in a secure way to the uppermost pier 40 and/or first portion 21 (e.g., the saddle 26). For example, nuts on top of the cap 28 are tightened and the hydraulic ram pressure released. Consequently, by operatively coupling the second portion 27 of the lifting apparatus 20 to the pier 40 and the first portion 21 of the lifting apparatus 20, the lifting apparatus 20, and thus the floor supported by the lifting apparats 20 is restricted from moving downwardly with respect to the one or more piers 40 installed in the ground 42. The lifting device any other couplings (e.g., additional rod couplers, additional lifting rods and/or caps, if utilized) are removed from the lifting apparatus 20. As will be described below, the one or more lifting rods 44 that remain protruding above the exposed surface of the floor (e.g., slab 22) are trimmed and the hole is patched with fill material (e.g., concrete, or the like).

In some of the embodiments, as illustrated in FIG. 3, the second portion 27 (e.g., cap 28) of the lifting apparatus 20 is operatively coupled to the first portion 21 of the lifting apparatus 20 through one or more second portion apertures 29 (e.g., cap bolt apertures, such as cap bolt holes), the one or more lifting rod apertures 43, and/or the one or more lifting rods 44. In some embodiments, the second portion apertures 29 are provided at opposite ends of the second portion 27 of the lifting apparatus 20. For example, the second portion apertures 29 in the second portion 27 are aligned with the one or more lifting rod apertures 43 in the first portion 21 of the lifting apparatus 20, such as in the base 34 of the saddle 26, as previously described herein.

In some embodiments the one or more lifting rods 44 are received through the apertures 43, 29 of the first portion 21 and the second portion 27 of the lifting apparatus 20. In some embodiments of the present disclosure, a pair of lifting rods 44 extend upwardly through the lifting rod apertures 43 at opposite ends of the saddle 26 and through the corresponding bolt apertures 29 at opposite ends of the cap 28, as illustrated in FIG. 3. The lifting rods 44 may be of a length greater than the thickness of floor (e.g., slab 22) so as to project upwardly from the first portion of the lifting apparatus 20 (e.g., from the saddle 26) and through the floor aperture in the floor (e.g., access opening 50 in the slab 22).

In some embodiments, the lifting rods 44 may have a head connected at one end. Alternatively, the lifting rods 44 may have threads on each end to connect to nuts 45. Moreover, the lifting rods 40 may have a smooth portion between the ends with the threads and/or head. The lifting rods 44 are operatively coupled to the first portion 21 of the lifting apparatus 20, such as the saddle 26, and to the second portion 27 of the lifting apparatus 20, such as the cap 28. The cap 28 is movable along the lifting rods 44. As illustrated at least in FIGS. 4A-5A, the second portion 27 of the lifting apparatus 20 is sized to at least partially fit within a section of a first portion 21 of the lifting apparatus 20 (e.g., the second portion 27 of the lifting apparatus 20 may at least partially nest within a nesting aperture within the first portion 21). For example, the cap 28 is shaped and sized to fit between the inner edges of the extension member 24 (e.g., nest within the plates, such as the discs 32) so that the cap 28 may be disposed between the walls 36 of the saddle 26 and/or below the plane of the extension plate 24, as needed (e.g., allows for more travel for lifting the slab 22 during the lifting process).

Figure 11:
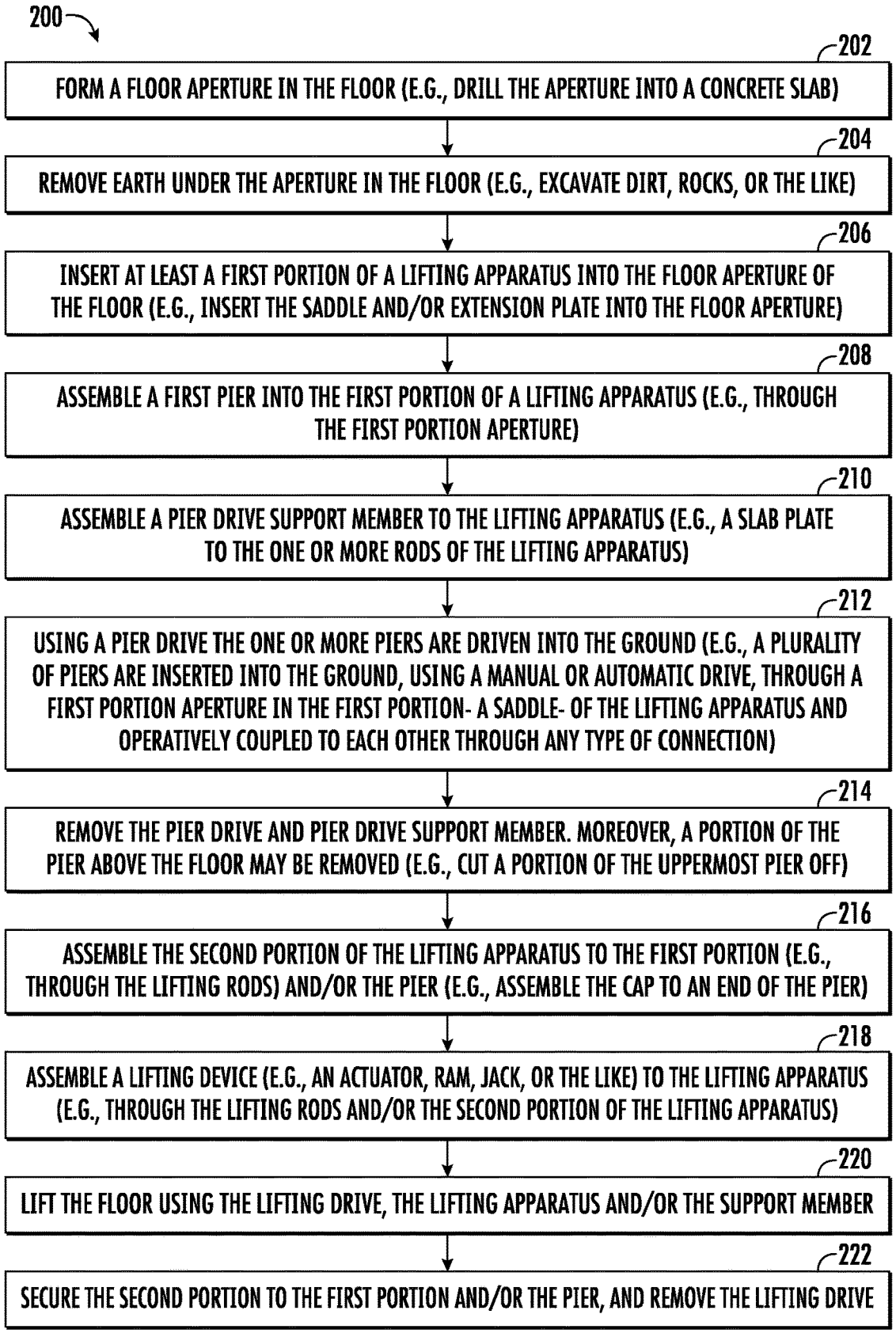
FIG. 11 illustrates a process for installing and using the lifting system, including the lifting apparatus, in accordance with embodiments of the present disclosure.

FIG. 11 illustrates an installation process 200 for installing the lifting system 1 to raise a floor (e.g., concrete slab 22, or the like). Block 202 of FIG. 11 illustrates that a floor aperture is formed in the floor, such as the floor of a building. For example, a circular floor aperture (e.g., access opening 50) of minimal size is cut (e.g., sawed, drilled, or the like) through the floor (e.g., the slab 22). The lifting apparatus 20 is shaped and sized such that the lifting apparatus 20 can be inserted and positioned under the slab 22 through a relatively small access opening 50 in the slab 22. The access opening 50 may be as small as about 5, 6, 7, 8, 9, 10, 11, 12, 14, 16, 18, 20, 22, 24, or the like inches in diameter, or range within, overlap, or fall outside of these values.

Figure 1B:
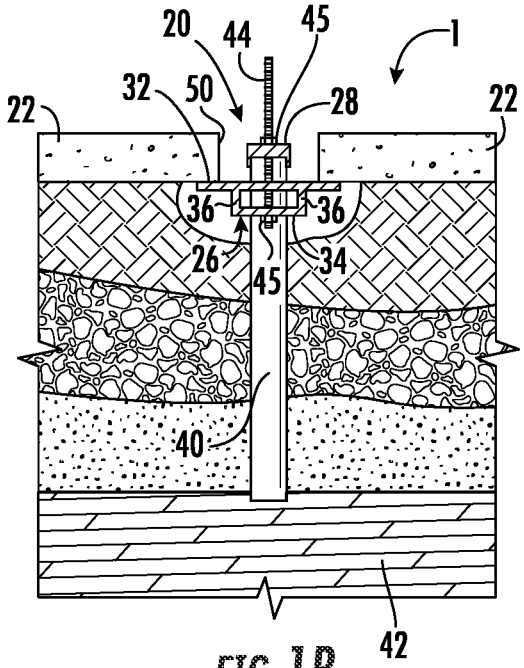
FIG. 1B is a side elevation view of the lifting system illustrated in FIG. 1A, in accordance with embodiments of the present disclosure.
Figure 2A:
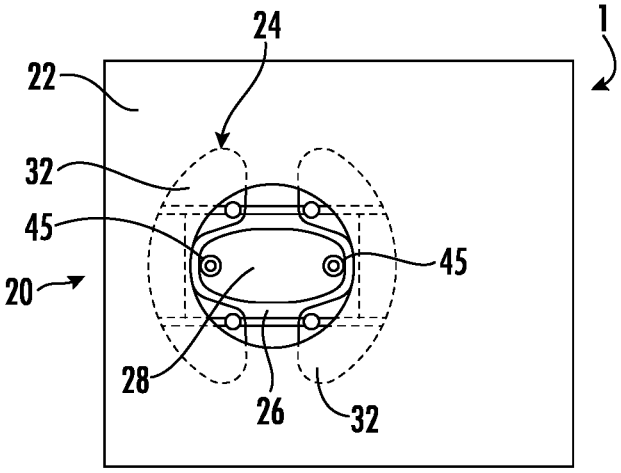
FIG. 2A is a top plan view of a lifting system including a lifting apparatus for lifting a concrete slab in a second front orientation approximately ninety degrees from the first side orientation illustrated in FIG. 1A, in accordance with embodiments of the present disclosure.
Figure 2B:
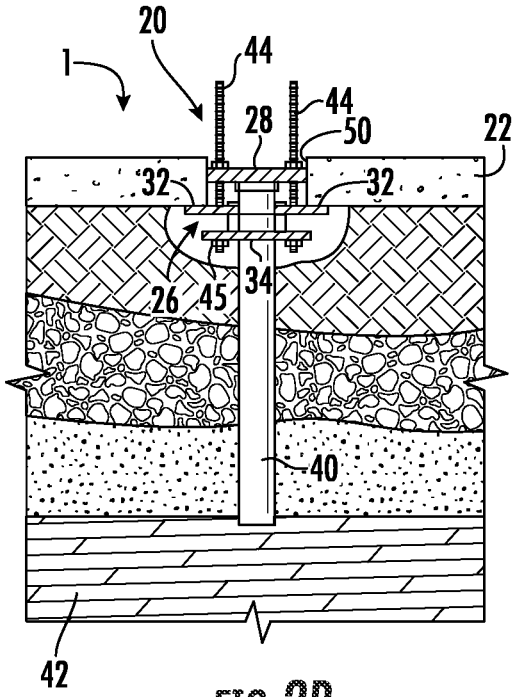
FIG. 2B is a front elevation view of the lifting system illustrated in FIG. 2A, in accordance with embodiments of the present disclosure.

FIG. 11 further illustrates in block 204, that earth (e.g., dirt, rocks, clay, or the like) is removed from under floor (e.g., slab 22). For example, a small excavation is made under the slab 22 in the area of the access opening 50 as shown in FIGS. 1B and 2B. The excavation only needs to be large enough (e.g., deep and/or wide enough) to accommodate at least a portion of the lift apparatus 20.

Figure 6:
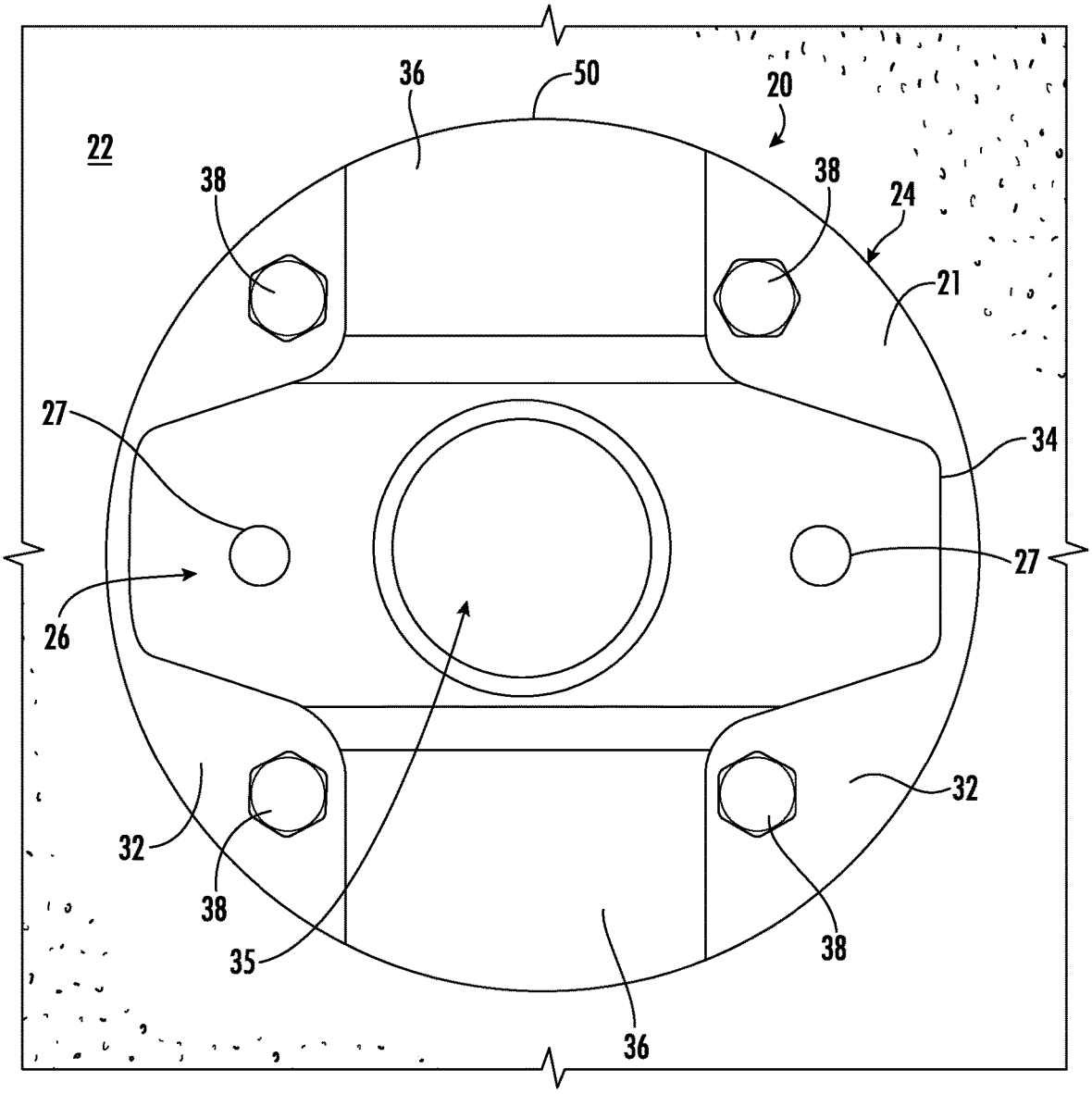
FIG. 6 is a top plan view of a first portion of the lifting apparatus as shown in FIG. 3 in position below a concrete slab as seen through a slab aperture in the concrete slab, in accordance with embodiments of the present disclosure.
Figure 7:
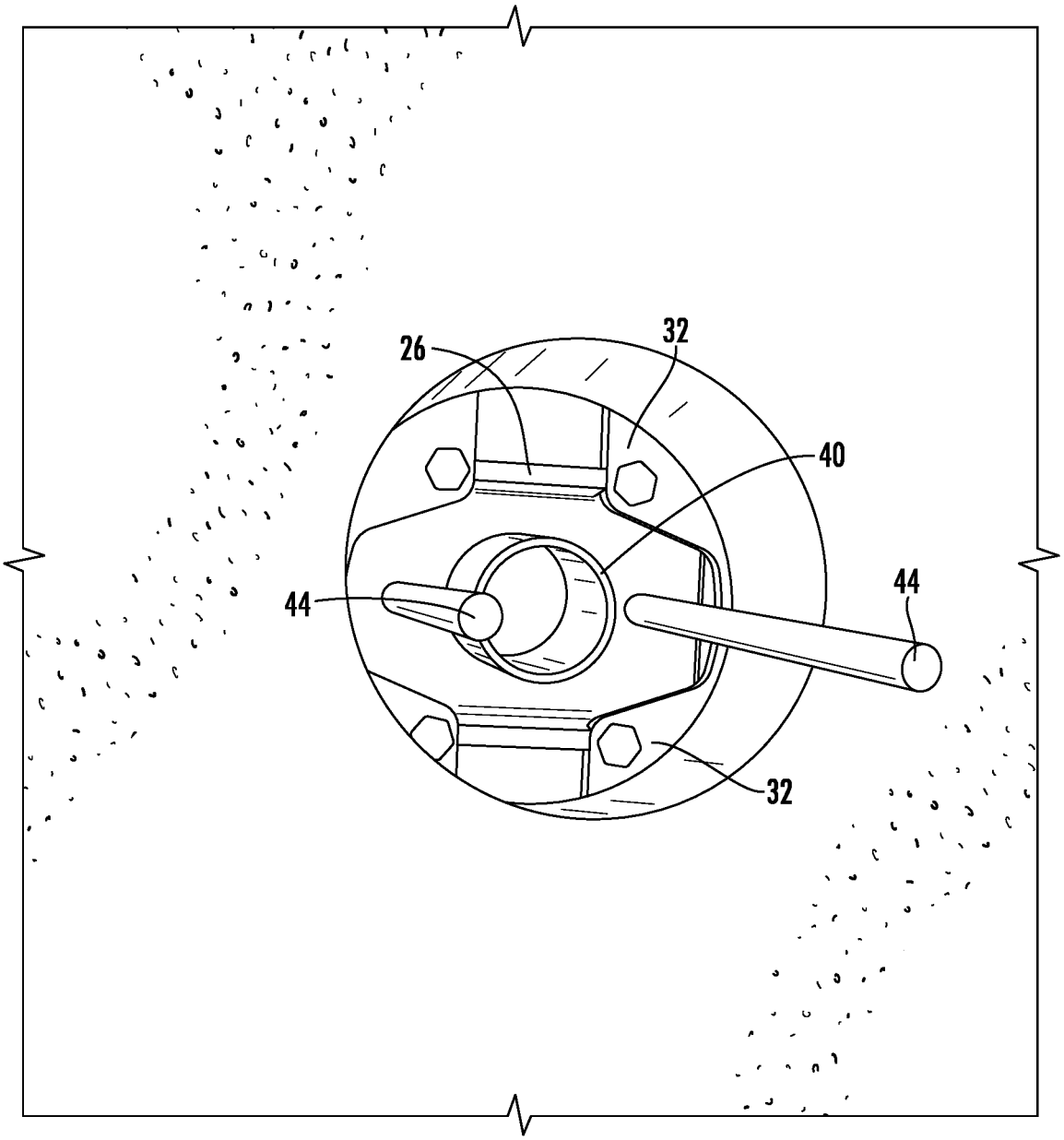
FIG. 7 is a top plan view of a first portion of the lifting apparatus as shown in FIG. 3 in position below a concrete slab as seen through an aperture in the concrete slab and with the lifting rods installed, in accordance with embodiments of the present disclosure.
Figure 8A:
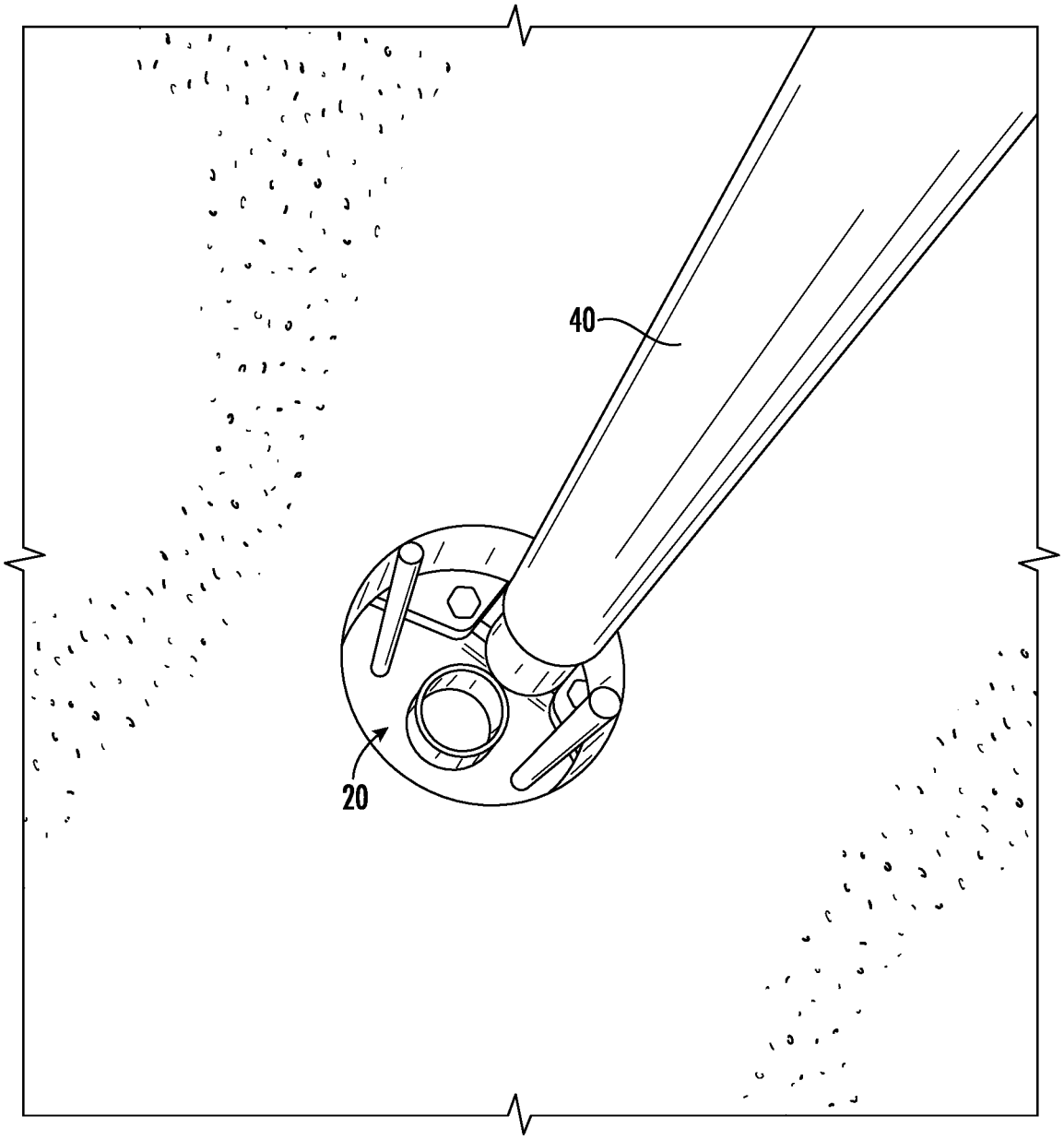
FIG. 8A is a top plan view of a first portion of the lifting apparatus as shown in FIG. 3 in position below a concrete slab as seen through an aperture in the concrete slab and with a pier being installed, in accordance with embodiments of the present disclosure.
Figure 8B:
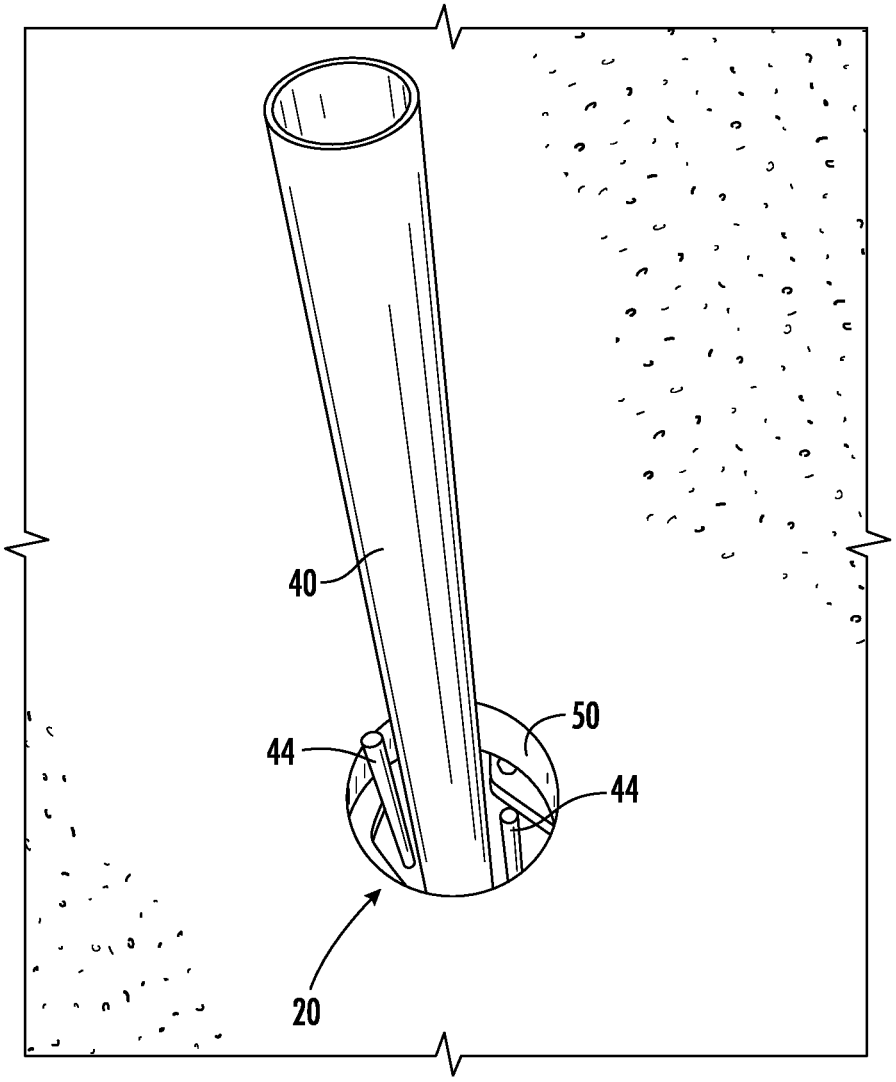
FIG. 8B is a top perspective view of a pier being installed within the lifting apparatus, in accordance with embodiments of the present disclosure.

Block 206 of FIG. 11 further illustrates that at least a portion of the lifting apparatus 20 is inserted through the access opening 50 into the excavation area under the slab 22, as illustrated in FIG. 6. For example, a first portion of the lifting apparatus 20, or a section thereof, such as the saddle 26, may be installed within the access opening 50. In this embodiment, the extension member 24 is operatively coupled to the saddle 26 after the saddle 26 is installed under the floor. Alternatively, the saddle 26 and the extension member 24 are operatively coupled together before insertion into the access opening 50. In this embodiment, the first portion 21 is inserted into the access opening 50 with the extension member 24 in the desired location, or alternatively, after insertion into the access opening 50, the extension member 24 may be adjusted with respect to the saddle 26. For example, the extension member 24 may be extended outwardly with respect to the saddle 26 (e.g., plates may slide along slotted apertures 33, 37 in the plates and/or saddle 26) in order to allow for engagement with the lower surface of the floor under which the first portion of the lifting apparatus 20 is to be operatively coupled. Consequently, the first portion 21 of the lifting apparatus 20 is installed to the position shown in FIGS. 1B and 2B. In some embodiments, as illustrated in FIGS. 1A, 1B, and 7, the apertures 33, 37 are accessible through the access opening 50 in the floor (e.g., slab 22) for the operative coupling and/or adjustment of the extension member 24 and the saddle 26. Moreover, it should be understood that one or more lifting rods 44 may be operatively coupled to the first portion of the lifting apparatus 20, as illustrated in FIG. 7. For example, two lifting rods 44 may be operatively coupled on opposite sides of the first portion aperture 35 in the first portion (e.g., in the extension member 24 and/or saddle 26). As discussed herein, the lifting rods 44 may extend past an exposed surface (e.g., upper surface) of the floor (e.g., slab 22) to aid in assembly of the one or more piers 40 and/or to lift the floor (e.g., slab 22).

FIG. 11 further illustrates in block 208 that a first pier is operatively coupled to the first portion 21 of the lifting apparatus 20 (e.g., inserted into the first portion aperture 35) of the lifting apparatus 20. For example, the pier 40 is inserted through a tubular member that is operatively coupled to the saddle 26 of the first portion 21 of the lifting apparatus 20. The pier 40 may be manually driven partially into the ground through the lifting apparatus 20.

Figure 9A:
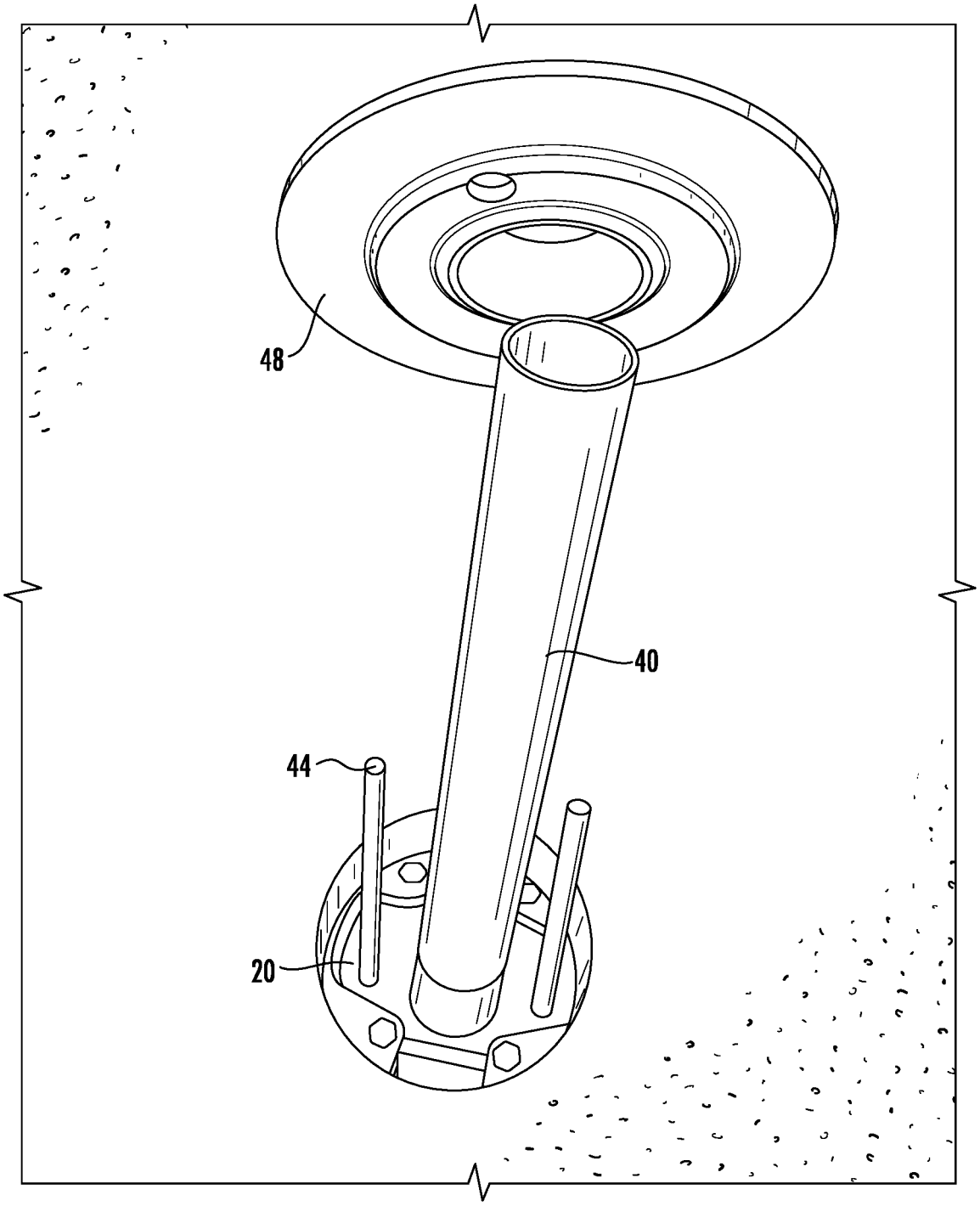
FIG. 9A is a top perspective view of the lifting system with a pier drive support member being installed over the pier and lifting apparatus, in accordance with embodiments of the present disclosure.
Figure 9B:
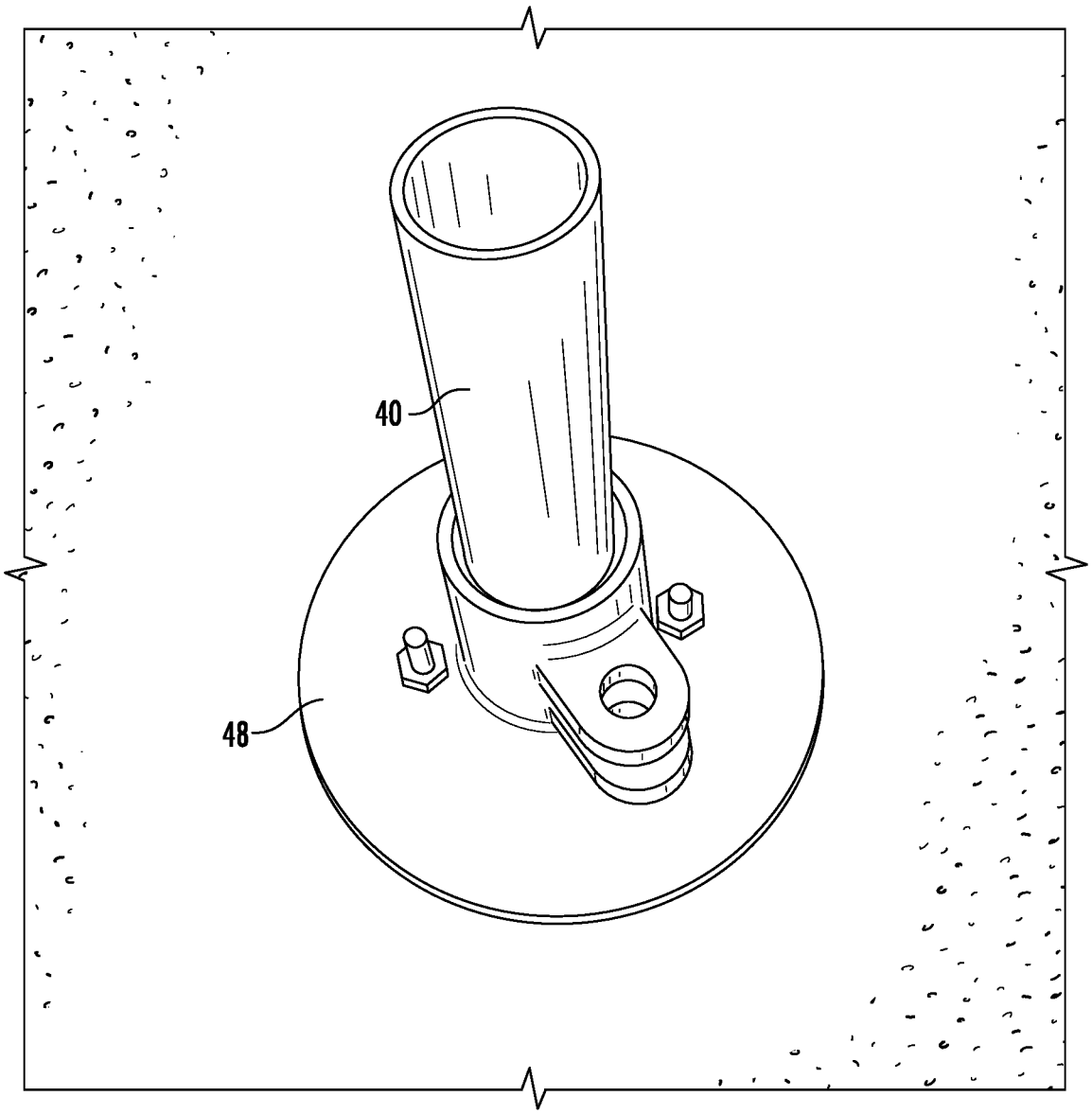
FIG. 9B is a top perspective view of the lifting system with a pier drive support member installed over the pier and lifting apparatus and a portion of the upper pier removed, in accordance with embodiments of the present disclosure.

Block 210 of FIG. 11 illustrates that a reusable pier drive support member 48 (e.g., slab member, such as a slab plate) may be operatively coupled to the lifting apparatus 20 through any suitable coupling, as illustrated in FIGS. 9A and 9B. For example, the pier drive support 48 may be bolted to the lifting apparatus 20 through the use of the lifting rods 44. However, it should be understood that any suitable coupling may be made. The pier drive support 48 may engage the upper surface of the floor (e.g., slab 22) to provide support for driving the one or more piers 40 into the ground 42.

Figure 10:
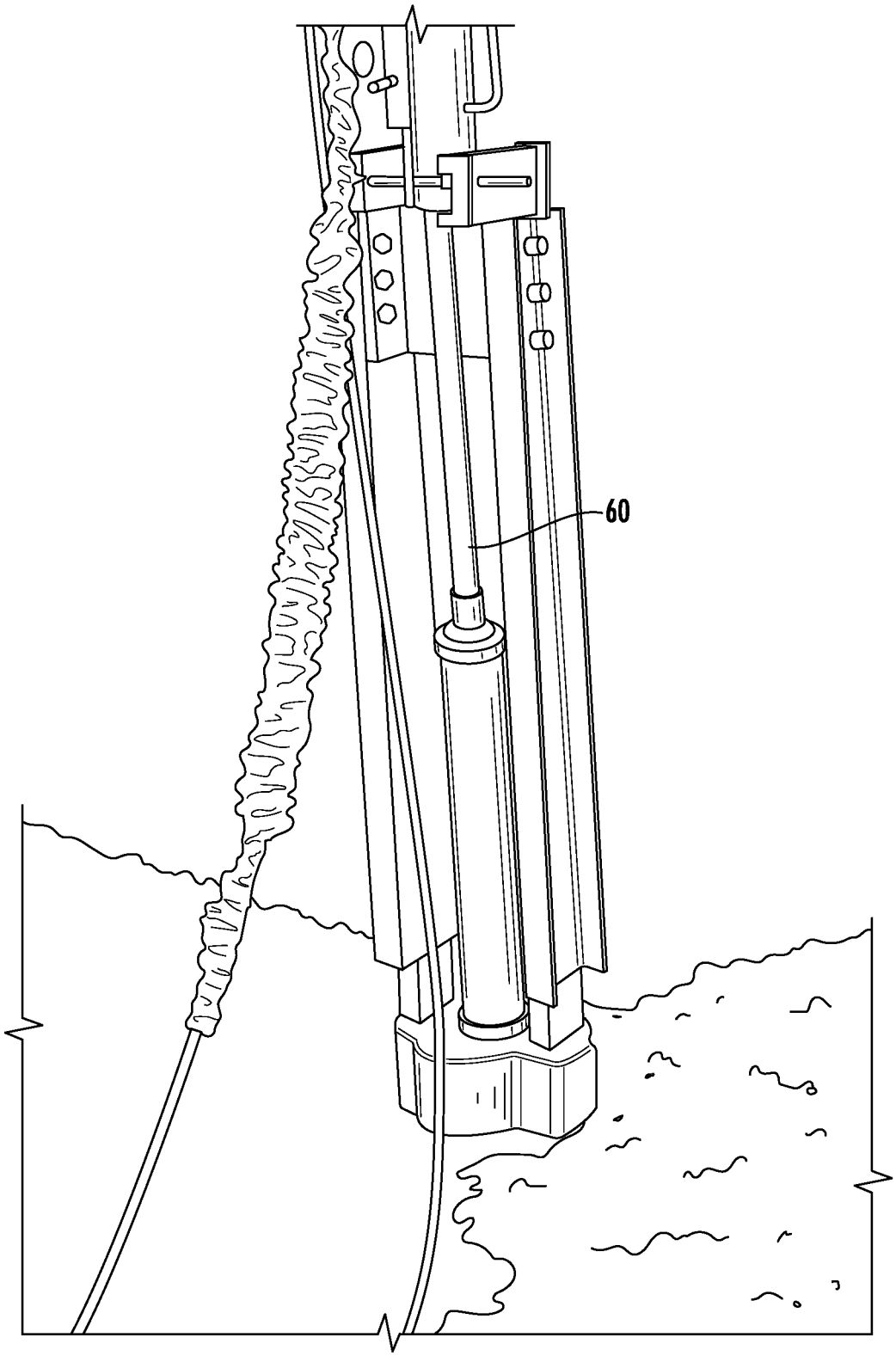
FIG. 10 is a top perspective view of a pier drive for use with the lifting apparatus, in accordance with embodiments of the present disclosure.

FIG. 11 further illustrates in block 212 that one or more piers 40 are inserted into the ground using a pier drive 60. The pier drive 60 may be any type of drive, such as manual drive, a hydraulic drive, a pneumatic drive, or any other type of drive that is used to insert the piers 40 into the ground. For example, as illustrated in FIG. 10, a cylindrical tubular push pier 40 may be driven downwardly into the ground under the floor (e.g., slab 22) through the first portion aperture 35 in the base 34 of the saddle 26 using a hydraulic ram and drive stand 60. Additional push piers 40 are sequentially driven through the first portion of the lifting apparatus 20 (e.g., through the saddle 26 under the slab 22) until a load-bearing formation (e.g., hardened soil, bedrock, or the like) is engaged by the lowermost push pier 40. The ends of each push pier 40 may be operatively coupled to each other by any suitable connection, such as but not limited to a welded connection, threaded connection, bolted connection, or the like.

As illustrated by block 214 of FIG. 11, after the one or more piers 40 have been installed into the desired position (e.g., desired depth), the pier drive 60 and/or the pier drive support member 48 are removed. Moreover, a portion of the remaining uppermost pier 40 may be removed, if necessary (e.g., depending on the location of the end of the uppermost pier 40 and/or the desired movement of the slab 22). For example, the uppermost push pier 40 may be cut off at a level just above, even with, or below, the exposed surface of the floor (e.g., a slab 22).

FIG. 11 further illustrates in block 216 that the second portion 27 (e.g., the cap 28) of the lifting apparatus 20 is operatively coupled to the pier 40 and/or the first portion 21 of the lifting apparatus 20. For example, the cap 28 is operatively coupled to the first portion 21 (e.g., the extension member 24 and/or the saddle 26) using the lifting rods 44, as previously described herein. It should be understood that the second portion 27 (e.g., the cap 28) of the lifting apparatus 20 may be operatively coupled to the first portion 21 of the lifting apparatus 20 and/or pier 40 to allow for movement (e.g., sliding movement) of the second portion 21. For example, the second portion 27 (e.g., the cap 28) may be installed to allow the second portion 27 to slide with respect to the lifting rods 44, as the floor (e.g., slab 22) is lifted.

FIG. 11 further illustrates in block 218 that a lifting device (not illustrated) is operatively coupled to the drive support 48 and/or the lifting apparatus 20. For example, a lifting device may be positioned above the slab 22 and operatively coupled to the lifting rods 44 and/or the second portion 27 of the lifting apparatus 20. In some embodiments additional removable lifting rods and/or caps may be utilized to operatively coupled the lifting device to the lifting apparatus 20, for example, depending on the configuration of the lifting device. The lifting device may be any type of lifting device known in the art, such a manual device, hydraulic device, pneumatic device, or the like (e.g., any type of actuator, ram, jack, or the like). For example, a hydraulic actuator or ram may be used, in which a cylinder is operatively coupled to the lifting rods 44 and/or second portion 27 (e.g., cap 28) of the lifting apparatus 20.

Block 220 of FIG. 11 illustrates that the lifting device may be used to lift the floor (e.g., the slab 22) using the lifting apparatus 20. For example, the lifting device may lift on the lifting rods 44 which applies an upward force on the lower side of the slab 22 (e.g., using the first portion 21 of the lifting apparatus 20) while restricting movement of the second portion 27 of the lifting apparatus 20. Alternatively, the lifting device may apply a force on the second portion 27 of the lifting apparatus while resisting movement of the lifting rods 44. In still other embodiments the lifting device may pull on the lifting rods and push on the second portion 27 of the lifting apparatus 20 at the same time.

Regardless of the type or operation of the lifting device, the lifting device applies a force to the lower surface of the floor (e.g, slab 22) through the first portion 21 (e.g., extension plate 24) in order to lift the floor. The lifting action is continued until the slab 22 is raised to a desired elevation (e.g., desired pre-determined elevation, or the like). The uniform and/or lateral extension of (e.g., around the sides of the access opening 50) the first portion of the lifting apparatus 20, such as the extension plate 24, may provide a uniform lifting force applied to the floor (e.g., slab 22). The floor (e.g., slab 22) is thus lifted vertically upwardly without any significant tilting or tipping, and thus, without damaging, or otherwise with minimizing the damage of (e.g., cracking, or the like) the floor.

Block 222 of FIG. 11 illustrates that after the floor (e.g., slab 22) is raised the second portion 27 of the lifting apparatus 20 is secured to the first portion 21 of the lifting apparatus 20. For example, nuts on top of the cap 28 are tightened on the lifting rods 44 such that the cap 28 cannot move with respect to the first portion 21 and/or the pier 40. Additionally, or alternatively, the uppermost pier 40 may be permanently secured to the lifting apparatus 20 by welding or other connection. After the lifting apparatus 20 and pier 40 have been stabilized, the lifting device, along with any additional couplings (e.g., additional rod couplers, additional lifting rods and/or caps, if any) are removed from the lifting apparatus 20. For example, the hydraulic ram pressure is released, and the ram is removed from the lifting rods 44. Consequently, by operatively coupling the second portion 27 of the lifting apparatus 20 to the pier 40 and the first portion 21 of the lifting apparatus 20, the lifting apparatus 20, and thus the floor supported by the lifting apparats 20, is restricted from moving downwardly with respect to the one or more piers 40 installed in the ground 42. The one or more lifting rods 44 that remain protruding above the exposed surface of the floor (e.g., slab 22) are trimmed and the hole is patched with fill material (e.g., concrete, aggregate, or other fill material).

The lifting apparatus 20 described herein may be installed for use in supporting and lifting a damaged foundation and/or foundation slab. The lifting system 1, including the lifting apparatus 20, may permit the foundation slab to be lifted to effect repairs on the floor, walls, or other components of the building. It should be further understood that multiple lifting apparatuses 20 (e.g., multiple lifting brackets) may be used in the field in order to lift a precast concrete slab to move the slab from one position to another raised position. The lifting system 1, including the lifting apparatus 20 thereof, may provide improvements over typical brackets and systems.

It should be understood that conventional brackets for supporting and lifting a foundation slab are typically embedded in a slab (instead of below the slab) in order to provide a lifting attachment location. However, it may be difficult to embed a conventional bracket into the slab 22, as well as to locate the conventional bracket out of sight. Moreover, by embedding the conventional bracket into the upper surface of the slab uniform loading of the slab may also prove difficult. That is, positioning the lifting apparatus 20 of the present disclosure under the slab (instead of embedded into the slab) provides are larger surface area and/or more stable location from which to lift the slab 22. It should be further understood that the lifting apparatus 20 only requires a small opening in a foundation slab for deploying the lifting apparatus 20, when compared to having to remove the current slab 22, excavate earth, and/or install a new slab 22, or a portion thereof. Moreover, the lifting apparatus 20 described herein is configured such that all couplings (e.g., bolt apertures) are exposed when the lifting apparatus 20 is in position under the floor (e.g., slab 22) to provide improved assembly with minimal disturbance to the slab 22 and/or ground 42 underneath the slab. At least for the foregoing reasons, the lifting system 1, and the lifting apparatus 20 thereof, provides improvements over conventional brackets and systems.

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGs. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

Moreover, it should be understood that "operatively coupled," when used herein, means that the components may be formed integrally with each other, or may be formed separately and coupled together. Furthermore, "operatively coupled" means that the components may be coupled directly to each other, or to each other with one or more components located between the components that are operatively coupled together. Furthermore, "operatively coupled" may mean that the components are detachable from each other, or that they are permanently coupled together. It should be further understood that variations of "operatively coupled" (e.g., "operative coupling", "operatively coupling", or the like) have the same meanings.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A lifting apparatus, the apparatus comprising:
- a first portion comprising:
  - a base;
  - walls operatively coupled to and extending from the base, wherein the walls and the base form a saddle having a trough; and
  - an extension member operatively coupled to the walls of the saddle, wherein the extension member is removable or adjustable horizontally with respect to the saddle;
- a second portion; and
- one or more lifting rods operatively coupled to the first portion and the second portion;
- wherein when installed the lifting apparatus is operatively coupled to a floor and to one or more piers such that:
  - the extension member of the first portion extends outwardly under the floor and is operatively coupled to a lower surface of the floor; and
  - the second portion is operatively coupled with the first portion and a pier of the one or more piers; and
- wherein during installation, a lifting drive lifts the floor and moves the second portion and first portion towards each other, and wherein after lifting the first portion, the second portion, and the one or more piers restrict downward movement of the floor.

2. The lifting apparatus of claim 1, wherein the extension member is removable with respect to the base; and wherein during installation the base is installed within a floor opening in the floor separately from the extension member.

3. The lifting apparatus of claim 1, wherein the extension member is adjusted horizontally with respect to the base to allow for installation within a floor opening in the floor and extension of the extension member horizontally under the lower surface of the floor.

4. The lifting apparatus of claim 1, wherein the extension member comprises:
- two or more plates, comprising at least a first plate and a second plate; and
- wherein the two or more plates have a surface that engages the lower surface of the floor adjacent a floor opening around a majority of a circumference of the floor opening.

5. The lifting apparatus of claim 4, wherein the first plate or the second plate are c-shaped plates.

6. The lifting apparatus of claim 1, wherein the second portion is a cap that is operatively coupled over an end of a last pier of the one or more piers.

7. The lifting apparatus of claim 6, wherein the cap comprises an alignment portion defining a pocket for receiving the end of the last pier.

8. The lifting apparatus of claim 6, wherein the end of the last pier of the one or more piers and an upper surface of the cap are configured to be located below an upper surface of the floor.

9. The lifting apparatus of claim 6, wherein the extension member of the first portion has one or more internal edges that define a nesting aperture, and wherein the cap has one or more outer edges that is configured to nest at least partially within the nesting aperture of the extension member of the first portion.

10. The lifting apparatus of claim 1, wherein the base has a first portion aperture that receives the one or more piers.

11. A lifting system, the lifting system comprising:

a lifting apparatus, the lifting apparatus comprising:

a first portion comprising:

a base;

walls operatively coupled to and extending from the base, wherein the walls and the base form a saddle having a trough; and an extension member operatively coupled to the walls of the saddle, wherein the extension member is removable or adjustable horizontally with respect to the saddle;

a second portion; and one or more lifting rods operatively coupled to the first portion and the second portion; and one or more piers operatively coupled to the second portion;

wherein when installed the extension member of the first portion extends outwardly under a floor and is operatively coupled to a lower surface of the floor; and wherein during installation a lifting drive lifts the floor and moves the second portion and first portion towards each other, and wherein after lifting the first portion, the second portion, and the one or more piers at least restrict downward movement of the floor.

12. The lifting system of claim 11, wherein the extension member is removable with respect to the base; and wherein during installation the base is installed within a floor opening in the floor separately from the extension member.

13. The lifting system of claim 11, wherein the extension member is adjusted horizontally with respect to the base to allow for installation within a floor opening in the floor and extension of the extension member horizontally under the lower surface of the floor.

14. The lifting system of claim 11, wherein the extension member comprises:

two or more plates, comprising at least a first plate and a second plate; and wherein the two or more plates have a surface that engages the lower surface of the floor adjacent a floor opening around a majority of a circumference of the floor opening.

15. The lifting system of claim 14, wherein the first plate or the second plate are c-shaped plates.

16. The lifting apparatus of claim 11, wherein the second portion is a cap that is operatively coupled over an end of a last pier of the one or more piers.

17. The lifting apparatus of claim 11, wherein the base has a first portion aperture that receives the one or more piers.

18. A method of installing a lifting system, the method comprises:

inserting at least a saddle of a first portion of a lifting apparatus in a floor aperture of a floor, the saddle comprising a base and walls operatively coupled to and extending from the base and forming a trough;

either assembling an extension member to the walls of the saddle or extending the extension member that is pre-assembled to the saddle horizontally outward from the saddle;

inserting one or more piers through the floor aperture of the floor using a pier drive;

assembling a second portion of the lifting apparatus to the first portion of the lifting apparatus and a last pier of the one or more piers; and assembling a lifting drive to the lifting apparatus;

lifting the floor using the lifting drive by moving the second portion and first portion towards each other;

removing the lifting drive from the lifting apparatus; and securing the first portion, the second portion, and the one or more piers to at least restrict downward movement of the floor.

19. A lifting apparatus, the apparatus comprising:

a first portion comprising an extension member operatively coupled to a base, wherein the base has a first portion aperture;

a second portion comprising a cap; and one or more lifting rods operatively coupled to the first portion and the second portion;

wherein when installed the lifting apparatus is operatively coupled to a floor and to one or more piers such that:

the extension member of the first portion extends outwardly under the floor and is operatively coupled to a lower surface of the floor; and the cap is operatively coupled with the first portion and over an end of a last pier of the one or more piers;

wherein the extension member of the first portion has one or more internal edges that define a nesting aperture, and wherein the cap has one or more outer edges that is configured to nest at least partially within the nesting aperture of the extension member of the first portion; and wherein during installation, a lifting drive lifts the floor and moves the second portion and first portion towards each other, and wherein after lifting the first portion, the second portion, and the one or more piers restrict downward movement of the floor.

20. A lifting system, the lifting system comprising:

a lifting apparatus comprising:

a first portion comprising an extension member operatively coupled to a base, wherein the base has a first portion aperture;

a second portion comprising a cap; and one or more lifting rods operatively coupled to the first portion and the second portion; and one or more piers operatively coupled to the lifting apparatus;

wherein when installed the lifting apparatus is operatively coupled to a floor and to the one or more piers such that:

the extension member of the first portion extends outwardly under the floor and is operatively coupled to a lower surface of the floor; and the cap is operatively coupled with the first portion and over an end of a last pier of the one or more piers;

wherein the extension member of the first portion has one or more internal edges that define a nesting aperture, and wherein the cap has one or more outer edges that is configured to nest at least partially within the nesting aperture of the extension member of the first portion; and wherein during installation a lifting drive lifts the floor and moves the second portion and first portion towards each other, and wherein after lifting the first portion, the second portion, and the one or more piers restrict downward movement of the floor.

* * * * *